United States Patent [19]

Lewis et al.

[11] Patent Number: 4,619,738

[45] Date of Patent: Oct. 28, 1986

[54] APPARATUS FOR OIL SHALE RETORTING

[75] Inventors: Arthur E. Lewis, Los Altos; Robert L. Braun, Livermore; Richard G. Mallon, Livermore; Otis R. Walton, Livermore, all of Calif.

[73] Assignee: The United States of America as represented by the United States Department of Energy, Washington, D.C.

[21] Appl. No.: 636,960

[22] Filed: Aug. 2, 1984

Related U.S. Application Data

[62] Division of Ser. No. 534,472, Sep. 21, 1983, abandoned.

[51] Int. Cl.[4] ..... C10B 1/04

[52] U.S. Cl. ..... 202/85; 201/28; 202/88; 202/99

[58] Field of Search ..... 201/12, 16, 28; 202/85, 202/91, 96, 120, 88, 99, 215; 208/8 R, 11 R

[56] References Cited

U.S. PATENT DOCUMENTS

| | | | |
|---|---|---|---|
| 2,377,512 | 6/1945 | Page | 208/148 |
| 3,503,869 | 3/1970 | Haddad et al. | 208/11 R |
| 4,336,128 | 6/1982 | Tamm | 208/11 R |
| 4,377,465 | 3/1983 | York | 208/11 R |
| 4,404,086 | 9/1983 | Oltrogge | 208/11 R |
| 4,539,917 | 4/1985 | Mallon et al. | 110/256 |

FOREIGN PATENT DOCUMENTS

| | | | |
|---|---|---|---|
| 17588 | of 1928 | Australia | 202/120 |
| 488460 | 10/1918 | France | 202/120 |
| 261290 | 10/1926 | United Kingdom | 202/120 |

*Primary Examiner*—Donald Czaja
*Assistant Examiner*—J. E. Cabaniss
*Attorney, Agent, or Firm*—Henry P. Sartorio; L. E. Carnahan; Judson R. Hightower

[57] ABSTRACT

A cascading bed retorting process and apparatus in which cold raw crushed shale enters at the middle of a retort column into a mixer stage where it is rapidly mixed with hot recycled shale and thereby heated to pyrolysis temperature. The heated mixture then passes through a pyrolyzer stage where it resides for a sufficient time for complete pyrolysis to occur. The spent shale from the pyrolyzer is recirculated through a burner stage where the residual char is burned to heat the shale which then enters the mixer stage.

16 Claims, 7 Drawing Figures

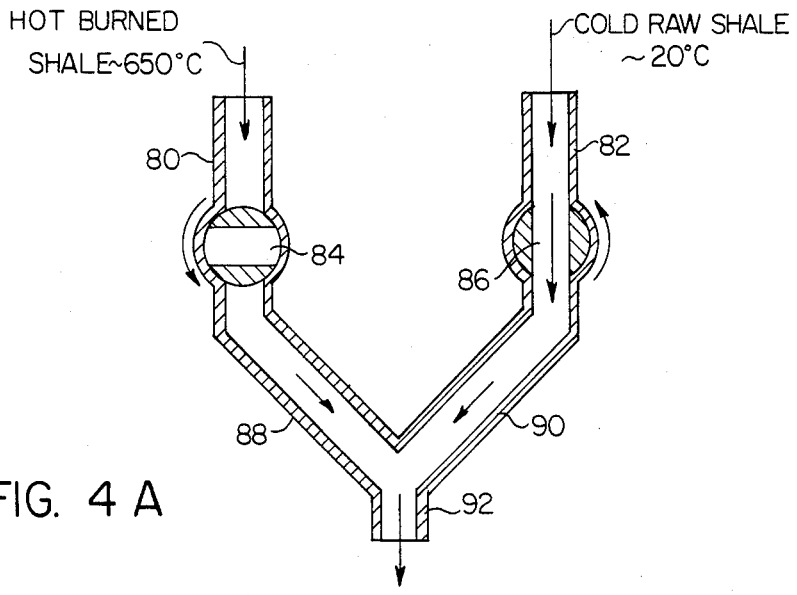
FIG. 4 A
FIG. 4 B
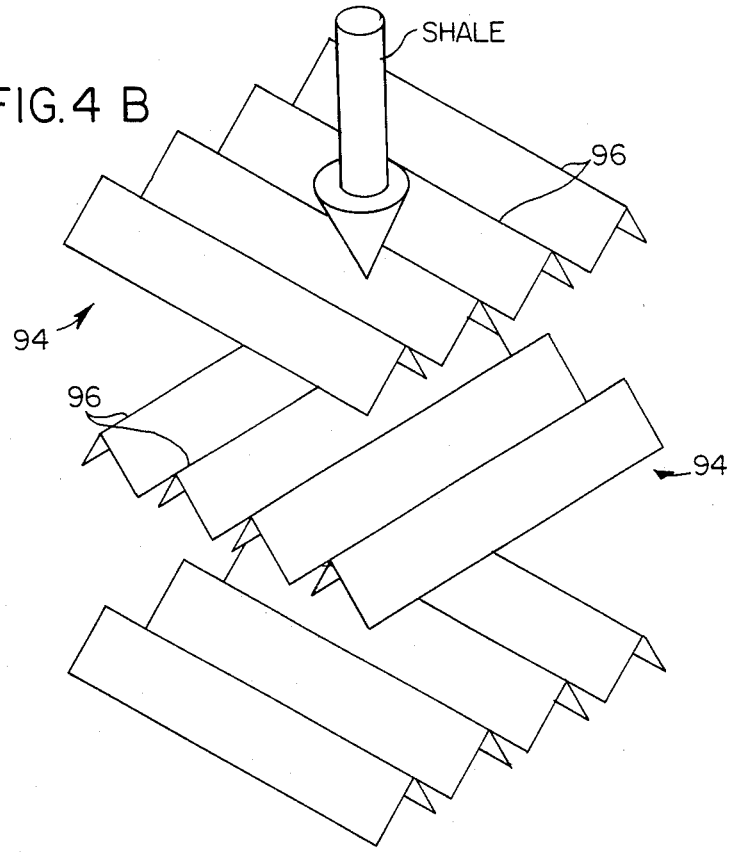

APPARATUS FOR OIL SHALE RETORTING

BACKGROUND OF THE INVENTION

The U.S. Government has rights in this invention pursuant to Contract No. W-7405-ENG-48 between the U.S. Department of Energy and the University of California, for the operation of Lawrence Livermore National Laboratory.

RELATED APPLICATIONS

This is a division of U.S. patent application Ser. No. 534,472 filed Sept. 21, 1983, now abandoned; Ser. No. 668,688 filed Nov. 6, 1984 is a continuation of Ser. No. 534,472.

The invention relates to methods and apparatus for surface retorting of oil shale, and more particularly to solid-solid heat transfer methods and apparatus for surface retorting of oil shale.

Oil shale contains a solid organic material, called kerogen. The rock must be heated to about 900° F. (450° C.) or higher for the kerogen to undergo a thermal decomposition (pyrolysis) to yield liquid shale oil and hydrocarbon gas, leaving behind on the matrix a char composed mostly of carbon.

Some energy is absorbed in decomposing kerogen, in driving off the water contained in minerals, and in decomposing or reacting part of the carbonate minerals in oil shale. Additional energy is carried out of the retort by product oil and gas, by spent shale, and by combustion gas to the extent that these products leave the retort at temperatures higher than their entrance temperatures. The most efficient process is one in which both oil and gas production is maximized, decomposition of carbonates is minimized, and heat loss is minimized. If energy is not wasted, char combustion can provide sufficient energy to run the process, to produce hydrogen by reaction with water; and possibly to provide excess energy.

All processes under consideration for commercial size module operations require that oil shale be divided or broken so heat can be applied to decompose the kerogen. In surface retorting processes, mined, crushed, and sized oil shale is heated in a retort by various methods to produce shale oil and other products. In modified-in-situ (MIS) processes, mining and blasting techniques are used to prepare underground chambers containing broken shale, which is then retorted in situ by using a combustion process. True in situ processes rely either on natural permeability or on permeability produced by using explosives to redistribute natural porosity. Heat is then provided by combustion underground or by introducing superheated steam or other hot gases which are heated outside the retort.

There are three basic types of surface processes: (1) combustion retort (direct heated), (2) hot gas retort (indirect heated), and (3) hot solid retort (indirect heated).

In a combustion retort, crushed oil shale flows countercurrent to a stream of air or other gases. At steady-state operation, oxygen in the gases burns char and fuel-containing gases introduced into the retort. The hot gases leaving the combusion zone heat the oil shale and decompose the kerogen. Oil and hydrocarbon gases are carried out of the retort where the oil is collected. The hydrocarbon gas is greatly diluted by the combustion products and nitrogen, and the outlet gas, therefore, has a very low heating value, ranging from 80 to 120 Btu/scf.

Part of the retort exhaust gas can be reintroduced into the retort at controlled locations and in controlled amounts. This recycled gas acts as additional fuel and as a control on peak temperatures and their locations. This additional gas improves the heat transfer to the shale and provides better isolation of oxygen from the oil-producing zone. This increases the yield by reducing the burning of the oil.

A big advantage of the combustion retort is the thermal efficiency of the heat transfer between the solid and the gas. Both gas and solid leave the retort at reasonably low temperatures. Another advantage is the lower capital equipment and operating costs because additional equipment for heating the heat transfer medium and recovering energy is not required or is minimized. The combustion retort also has several disadvantages. The hydrocarbon gas must be used locally or burned in the retort because its low heating value prevents it from being transported economically to other areas. Less than half of the char is utilized as fuel in the process, and high combustion temperatures result in decomposition of some of the carbonate, thereby wasting energy. An additional problem is that the finest material from the crusher (5 to 15 percent) would interfere with the gas flow in the retort and, therefore, cannot be processed in this type of unit.

The major example of this direct combustion process is the Paraho unit (the Paraho retort can also be designed and operated as an indirect heated process). Other types of units including Union, Petrosix, and Superior can also be operated in the direct-heated mode. Shale oil yields for direct combustion processes are reported to be as high as 90 to 95 percent of Fischer assay of the feed to the retort. The Paraho process uses gravity to move shale through the retort. Pilot units have been operated for extended times at a charge rate of 280 tons per day (t/d) of raw shale, and well over 100,000 barrels of raw shale oil have been produced.

The hot gas or indirect-heated retort uses a non-oxidizing gas heated external to the retort that passes through the retort countercurrent to the crushed shale to supply the heat necessary for the retorting operation. Yields of 95 to 100 percent can be obtained. The retort itself is similar to but less complicated than a similar type retort operated in the gas combustion mode. However, the process external to the retort is more complicated. The non-oxidizing gas is heated indirectly by burning product gas or the char on the shale leaving the retort. Shale leaves the retort at a high temperature near 900° F. (450° C.), and separate steps are required to recover this heat. However, temperature control in the retort is no problem and carbonate decomposition is avoided.

The hot gas process provides good control of the retort and high yields although at the cost of lower thermal efficiency and more complicated external equipment. Like the direct combustion process, it cannot handle significant quantities of fine material. Examples are the Union, Petrosix and Superior processes. Union uses a retort similar to the gas combustion retort but utilizes a "rock pump" to force shale upward through the retort. Superior uses a horizontal moving grate to carry the shale through the retort. The Union retort (in the gas combustion mode) has operated at throughputs of 1200 t/d and the Superior retort at 250 t/d. Union Oil Company is scheduled to start production (10,000 bbl/day) in Fall 1983.

The hot solid processes utilize hot solids (spent shale or ceramic balls) heated outside of the retort as heat transfer media. This hot solid is mixed with raw shale in the retort and both the oil and gas are driven off and collected. The gas has a high enough heating value to be commercially useful and may be processed for sale or utilized on site. In the Tosco II process, the gas is used to heat one-half inch diameter ceramic balls. These are mixed in the reactor with smaller sized shale and after leaving the reactor are separated and reused. The use of a liftpipe combustor imposes operational constraints and limits particle sizes to a narrow range of about 5–7 mm. In the Chevron and Lurgi-Ruhrgas processes the char on the spent shale is burned and the hot spent shale is used as the heat-transfer medium. In both, process heat for retorting is supplied by burning the spent shale in a separate combustion chamber and returning the reheated shale to the retort where it mixes with fresh incoming shale. Transport of the spent shale from the bottom to the top of the retort and combustion are accomplished by controlled vertical air flow in a liftpipe combustor. In the Chevron process, the solid heat transfer agent is mixed with incoming crushed shale in a fluidized bed; in the Lurgi process, hot fines are mixed with incoming shale in a mechanical screw feed arrangement. A disadvantage of the Chevron process is the need for gas processing facilities to support the fluidized bed. A major disadvantage of the Lurgi process is the requirement for large moving mechanical equipment (the screwmixer) which is capable of withstanding the high retort temperatures. In all these hot solid processes large masses of hot solids must be processed and external heat exchangers used to recover the heat or the processes would not be thermally efficient. These processes have the advantages of high yields (90 to 100 percent) and the ability to process all the mined shale, including the fines rejected in the hot gas and gas combustion processes. Costs of crushing the feed to the smaller particle sizes are greater, however. The Tosco II process has been operated at rates near 100 t/d and the Lurgi and Chevron processes at rates near 15 t/d.

Various embodiments of the Chevron process are illustrated in U.S. Pat. No. 4,199,432 to Tamm, et al, which shows a fluidized bed with horizontally disposed perforated plates to slow larger particles and a liftpipe combustor; U.S. Pat. No. 4,336,128 to Tamm, which shows a fluidized bed with perforated horizontal plates along with a separate fluidized bed combustion chamber having perforated plates to increase residence time; U.S. Pat. No. 4,336,127 to Bertleson; and U.S. Pat. No. 4,332,669 to Spars, et al.

U.S. Pat. No. 2,717,869 to Turner shows a fluidized bed retort with horizontal baffles to prevent particle free fall and increase residence time for distillation of oil-bearing minerals.

Modified in situ (MIS) processes are based on the concept of preparing broken rock in underground chambers and retorting in situ. The advantage of this process is that only a part of the shale, 20 to 40 percent, is mined and brought to the surface in order to provide void space necessary for the proper operation of the retorting process. The mined shale is processed in surface retorts. The 60 to 80 percent of the shale remaining underground needs only to be broken and distributed uniformly to prepare it for in situ retorting. The in situ retorting process is similar to the direct combustion process except that the shale remains stationary and the combustion and retorting fronts move downward through the shale. However, there are important differences.

The rock broken in situ cannot be carefully crushed and sized and the fines removed, as it is in surface processing. Larger fragments and a wider distribution of sizes must be processed. This requires a slowdown in retorting from 40 to 50 meters per day (m/d) to 1 to 3 m/d, or possibly less. Because of the grade and particle-sized distribution, the maximum recovery of shale oil expected is in the range of 55 to 70 percent for that part of the retort swept by the retorting front. The oil yield is further reduced if part of the retort is not swept by the retorting front. For example, if 60 percent of the retort is swept by the retorting front, the sweep efficiency is 60 percent, and the overall efficiency of recovery is the product of the sweep efficiency and the maximum recovery.

The gas flow through a retort must be uniform to obtain good sweep efficiency. The effective gas permeability through the broken shale bed must be nearly constant across the entire bed in order to achieve uniform burning rates and good sweep efficiencies. Achievement of uniform effective gas permeability by explosively fracturing the remaining 60 to 90 percent of the rock after mining is very difficult. Thus, the achievement of sweep efficiencies significantly greater than 0.60 have not been demonstrated to date. It is essential that a uniform distribution of shale be produced to obtain a large yield of oil from the swept region of the retort.

There are other differences between MIS and surface retorting processes. The use of recycle gas to control temperature is not practical because the additional fuel slows the rate of retorting further. The entry point of the gas, or of the air, cannot be easily controlled, and the gas is a hazard underground because of its hydrogen sulfide and carbon monoxide content. Other gases such as steam are used to dilute the air to control peak temperatures.

Two MIS processes have been tested using large size in situ retorts, one by Cathedral Bluffs Oil Shale Company and the other by Rio Blanco Oil Shale Company. The major differences between the processes is in the methods of retort formation and rock fracturing.

It is an object of this invention to provide method and apparatus for surface oil shale retorting having improved heat transfer from burned recirculated shale.

It is also an object of the invention to provide method and apparatus for surface oil shale retorting utilizing gravity-driven solids flow for improved mixing and heat transfer between hot recirculated shale and cold raw shale.

It is a further object of the invention to achieve improved mixing and a prescribed residence time in a gravity-driven solid-solid heat exchange oil shale retort.

SUMMARY OF THE INVENTION

The invention is a cascading bed retorting process and apparatus in which raw crushed shale enters at the middle of the retort column, where it is rapidly mixed with recycled shale that has been heated by burning its residual char. The mixing is performed by flowing the shale particles down a series of vertically spaced alternately opposed inclined planes which extend laterally so as to overlap. The mixed streams of shale fall into a pyrolyzer section, where heat from the recycled shale drives the volatile matter out of the raw shale. The volatile products are drawn off rapidly through product-gas vents and cooled to limit coking and cracking of the oil and oil vapors at elevated temperatures.

By the time the raw shale reaches the bottom of the pyrolyzer, it contains only char. This spent shale is recycled to the column. A blast of air picks it up and carries it through a pneumatic liftpipe to the top of the column, where the solids are separated from the gas and fed back into the cascading burner. The burner utilizes an arrangement of inclined planes similar to the mixer. Here, air is introduced as an oxidant and the burning char heats the recycled shale enough to provide a new source of hot solid which can be used to pyrolyze additional raw shale. Enough hot shale is ejected at the burner exit to match the amount of raw shale being added at that point.

The rapid mixing so important to efficient operation occurs naturally as the streams of rock cascade down the alternating ramps. As particles of all sizes tumble together down a ramp, the larger particles rise to the top of the layer and the smaller particles sift down to the bottom. When the stream falls off the end of the ramp, it inverts itself and the segregation process starts over. The invention utilizes these solid-flow processes to provide constant segregation and inversion, which mixes the recycled and raw shales within a few seconds.

BRIEF DESCRIPTION OF THE DRAWINGS

FIGS. 4*a* and 4*b* illustrate alternate embodiments of the mixer.

DETAILED DESCRIPTION OF PREFERRED EMBODIMENTS

Figure 1:
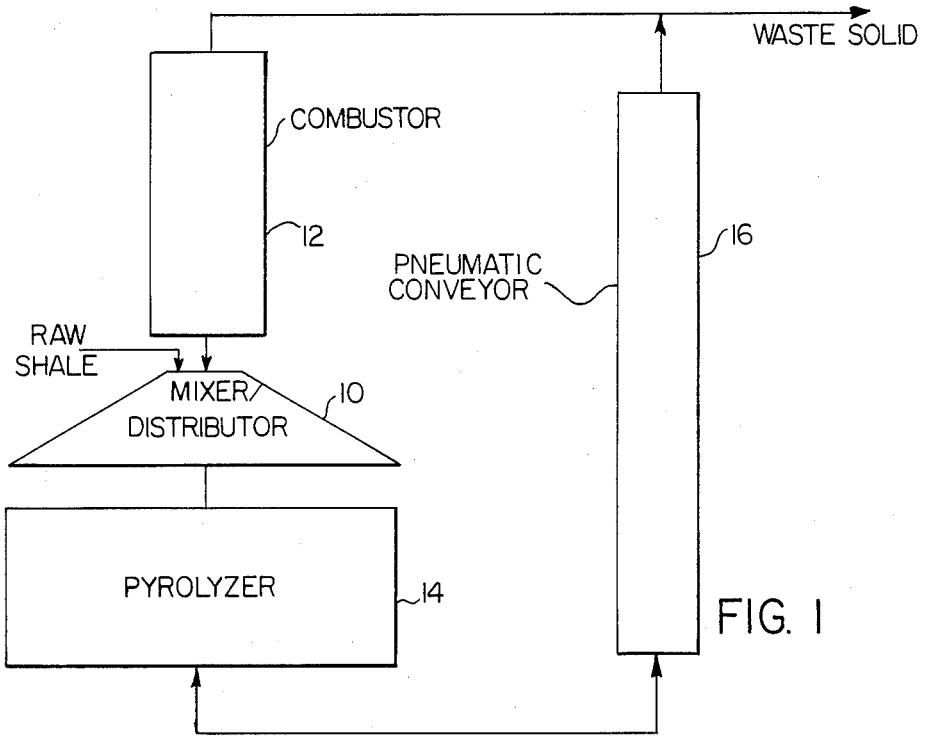
FIG. 1 is a schematic diagram of the cascading bed retort process.

The cascading bed retorting process illustrated schematically in FIG. 1 is a gravity-driven solid-solid heated exchange process for oil shale retorting in which cascaded flow of oil shale down a vertical series of overlapping inclined planes, where successive planes extend from opposite sides, provide optimum mixing and heat transfer and retard flow to provide sufficient residence time. In the process, cold raw oil shale is heated in a mixer or distributor stage 10, by transfer of heat from hot burned shale coming from a combustor stage 12. The two streams of shale, cold raw shale and hot burned shale, after mixing, are distributed from the distributor stage 10 as a uniform mixture into the pyrolyzer stage 14 where the shale flows downward by gravity. The pyrolyzer stage 14 provides sufficient residence time at a sufficient temperature, about 500° C., for the kerogen in the shale to decompose and produce shale oil, gas and char. Gas and oil vapors are withdrawn from the pyrolyzer stage 14 and sent to a condenser or separator (not shown). The spent shale from the pyrolyzer stage 14 is transported by an airstream through pneumatic conveyor 16 to the top of the combustor 12. Alternately, any mechanical type of conveyor is suitable. Some waste shale is also removed at the top of the pneumatic conveyor 16 or some other convenient location to maintain a constant flow of solid. The spent shale from pyrolyzer stage 14 contains char which can be burned in order to raise the temperature of the shale. The spent shale which has been recirculated from pyrolyzer 14 through pneumatic conveyor 16 to the top of combustor 12 flows downward through the combustor 12 and is heated to about 650° C. by combustion of the char in air. The hot burned shale from the combustor 12 is again mixed with raw shale in the mixer/distributor 10, and the process is repeated.

Utilizing the invention, a wide range of particle sizes can be processed. The shale particle sizes may be as large as about 15–20 mm. The approximate residence times of the shale in the various stages of the process are typically about 25 seconds in the combustor, about 5 seconds in the mixer/distributor, about 2 minutes in the pyrolyzer, and about 5 seconds in the pneumatic conveyor. More generally, the residence time in the burner is short, less than 1 about minute, and preferably about 10–25 seconds; the residence time in the pyrolyzer is about 2–5 minutes; and the residence time in the mixer is less than about 30 seconds. These process times are the minimum required by heat transfer and reaction times. Therefore, these operating parameters maximize the rate at which oil shale can be processed and minimize the size of the reaction vessels required. The process is gravity-driven. The flow rates and residence times are controlled by baffles or other flow control mechanisms. The raw shale is heated indirectly by mixing and heat exchange with recirculated spent shale which has been burned to provide process heat.

Figure 2:
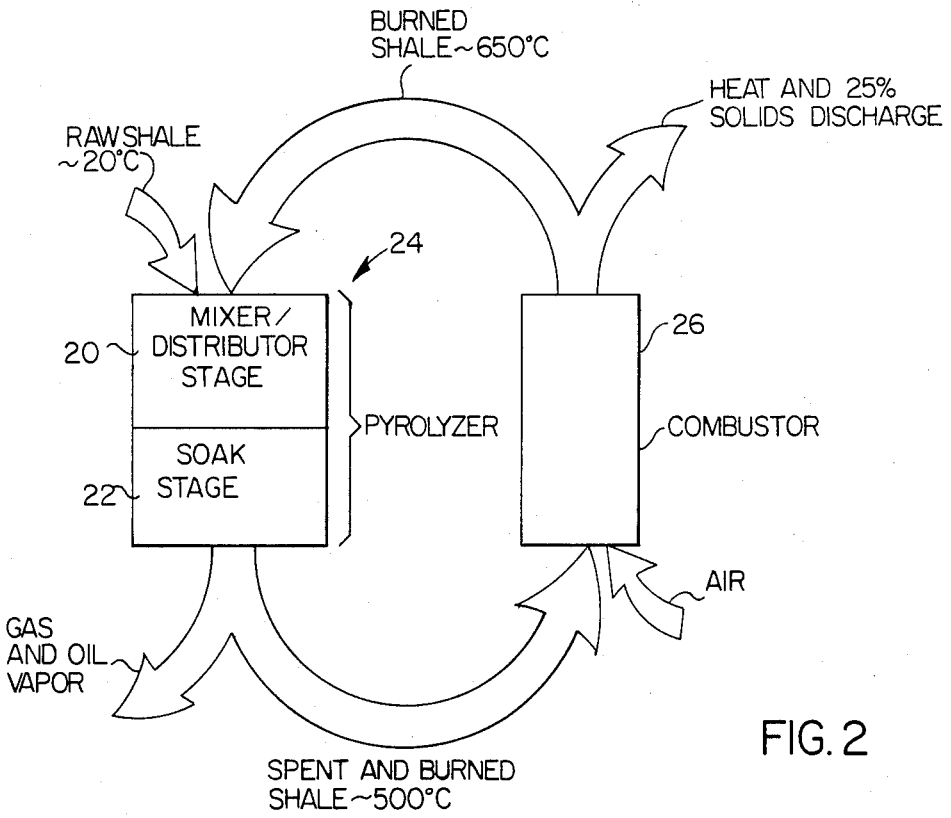
FIG. 2 is a schematic diagram (alternate embodiment) of a solids recycle gravity mixed retort process.

An alternate embodiment of the process is illustrated schematically in FIG. 2, in which burned shale at about 650° C. and raw shale at about 20° C. are input at the top of a gravity-driven mix stage 20 in a pyrolyzer 24. The cold raw shale and hot burned shale are mixed to provide process heat, and flow downward by gravity to the soak stage 22 of pyrolyzer 24. Soak stage 22 provides sufficient residence time at about 500° C. to decompose the kerogen in the raw shale. Gas and oil vapors are removed from the soak stage 22 to condensers for recovery. The mixture of spent and burned shale from the soak stage 22 is recirculated by means of an airstream through liftpipe combustor 26, where the char in the spent shale is burned to heat the shale to about 650° C. This hot burned shale is again mixed with raw shale in the mix stage 20 of the pyrolyzer 24, and the process continued. Some heat and solid are removed from the top of the liftpipe combustor 26. Both embodiments illustrated in FIGS. 1 and 2 utilize gravity flow with interruption and gravity mixing of recycled solids for indirect heating. In the embodiment of FIG. 1, a 3-stage gravity-driven process is utilized, whereas in the embodiment shown in FIG. 2, a 2-stage gravity-driven process with a conventional liftpipe combuster is utilized.

Figure 3:
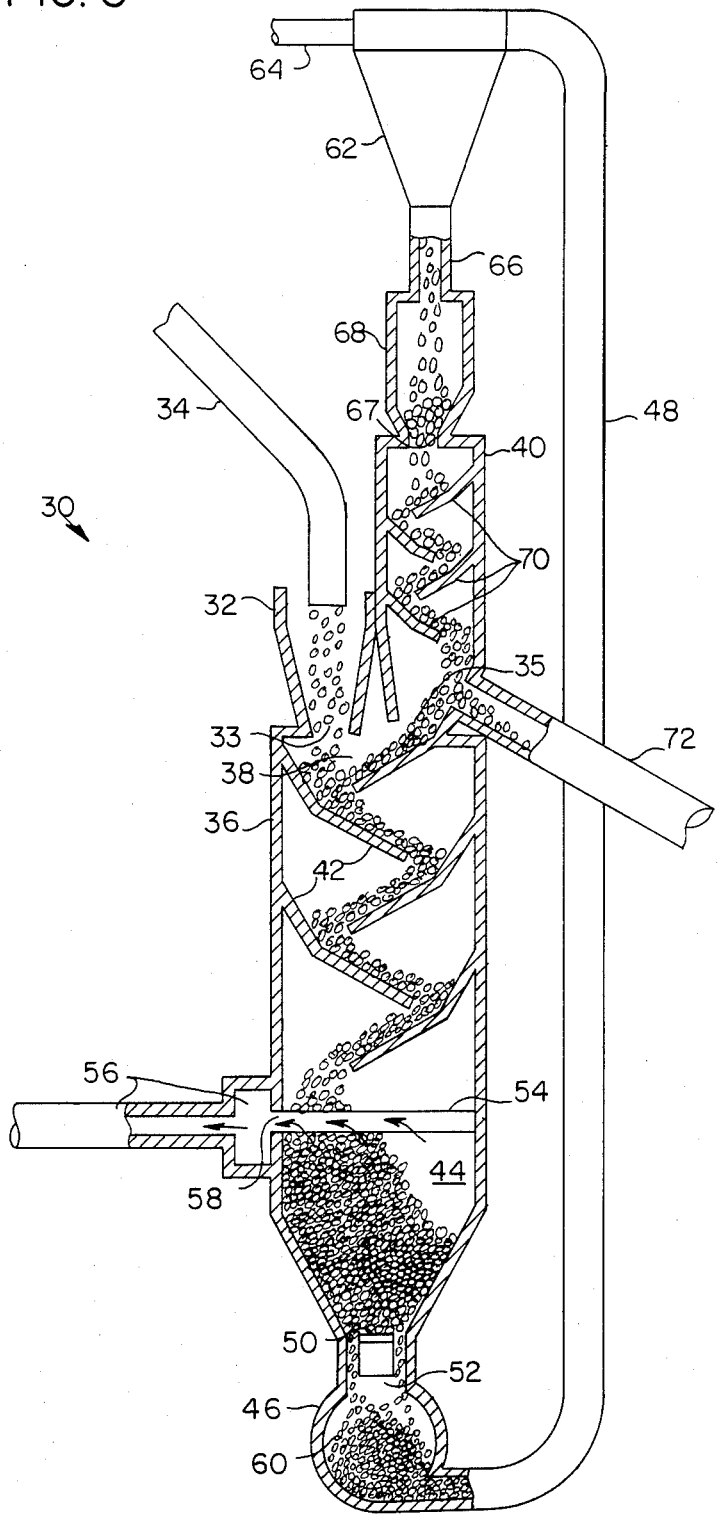
FIG. 3 is a view of a preferred embodiment of the cascading bed retort for carrying out the process illustrated in FIG. 1.

A preferred embodiment of the invention is the cascading bed retort 30 illustrated in FIG. 3. Raw crushed shale is fed into a hopper 32 by means of conveyor belts or pipe 34. The hopper 32 is mounted on top of and communicates with mixer 36. The hopper 32 is generally V-shaped, and funnels raw shale through opening 33 into the opening 38 at the top of mixer 36. Cascading burner 40 is also mounted on top of and communicates with mixer 36 through opening 35. The hopper 32 is adjacent to the cascading burner 40. Hot burned shale from cascading burner 40 is also funneled into the opening 38 at the top of mixer 36, where it combines with the stream of raw shale from the hopper 32. The mixer 36 has a plurality of overlapping, downwardly sloped internal baffles 42 extending alternately from opposite sides of the mixer 36. The combined stream of cold raw shale at about 20° C. and hot burned shale at about 650° C. cascades down the mixer 36 along the baffles 42. At each successive baffle 42, a change in flow direction and an inversion of the flowing layer of shale occurs, as will be more fully described later, which provides intimate mixing of the two streams of shale and effective heat transfer, raising the temperature of the raw shale to about 500° C. when it exits from the mixer 36. The mixer 36 is mounted above and communicates with pyrolyzer 44. The pyrolyzer 44 is substantially funnel-shaped at the bottom and is mounted above and communicates with the lower section 46 of liftpipe 48. The heated shale mixture from the mixer 36 flows down through the pyrolyzer 44 by gravity, remaining in the pyrolyzer 44 for a sufficient time for complete pyrolysis to occur. A plurality of parallel angled baffles 50 are mounted in the opening 52 between the pyrolyzer 44 and pipe 46 to channel the flow of the spent shale and also provide flow control at this point 52. Adjustable size openings at 67, 33, 35, and 52 provide flow control and also allow a sufficient quantity of solids to remain above each opening to achieve a partial gas block to prevent mixing of oxidizing and reducing gases that exist in various parts of the overall retort. A plurality of aligned and spaced gas collection channels 54 extend across the top portion of pyrolyzer 44. The channels 54 communicate with a manifold 56 mounted on the outside of the pyrolyzer 44 through product gas vents 58. The function of the gas collection channels 54 is to remove the oil vapor and gas products released in the pyrolyzer bed during the retorting process. Otherwise, the large amounts of gas produced would fluidize the pyrolyzer bed, disrupting the retorting process, and also flow back up into the mixer 36. The shale which falls into pipe 46 includes spent shale from the pyrolysis of raw shale fed into the retort 30 through hopper 32; this spent shale contains char which may be burned to provide process heat. The char-containing shale mixture in pipe 46 is recirculated by flowing an airstream through the end 60 of pipe 46 and transporting the shale up through liftpipe 48 to a solid/gas separator 62 mounted at the top of the retort. The removal of shale from pipe 46 allows more shale from the pyrolyzer 44 to fall into pipe 46, maintaining a continuous flow of material. In separator 62, any gas products are separated and removed through outlet 64. The solid recycled shale flows from the separator 62 down through communicating tubes 66 into hopper 68 mounted on top of and communicating with cascading burner 40. The hopper 68 funnels recycled shale at about 500° C. into the top of cascading burner 40, e.g., through controlled opening width funnel 67. The recycled shale flows down through the cascading burner 40, passing over a plurality of overlapping, downwardly sloped baffles 70, successive baffles being mounted to opposite sides of the burner 40. While cascading through the burner 40, the char in the recycled shale is burned by introducing air or oxygen to support combustion to heat the recycled shale to a temperature of about 650° C. at the bottom of burner 40, where the hot recycled shale flows into opening 38 and mixes with cold raw shale from hopper 32 flowing into mixer 36.

Further details of the cascading burner 40 are disclosed in related patent application, "Combustion Heater for Oil Shale", by Richard Mallon, Otis Walton, Arthur Lewis and Robert Braun, Ser. No. 534,427 filed herewith, now U.S. Pat. No. 4,539,917, issued Sept. 10, 1985, which is herein incorporated by reference. Since the combustion process to provide process heat to drive the retorting process is carried out in the cascading burner 40, the liftpipe 48 need only be a pneumatic lift rather than a liftpipe combustor, thereby facilitating the operation of the liftpipe. However, any combustion that occurs in liftpipe 48 may be beneficial, since it preheats the recirculated shale and requires less of the combustion process to occur in the cascading burner 40. In place of the pneumatic liftpipe 48, any other mechanical or other conveyor means can be utilized to remove processed spent shale flowing out of the pyrolyzer 44 and recirculating the spent shale to the top of the retort 30 where it is input into the cascading burner 40. In an alternate embodiment of the invention, as illustrated schematically in FIG. 2, a liftpipe combustor could be utilized and the cascading burner 40 thereby eliminated. Some hot spent shale is removed from the cascading burner 40 by means of exit pipe 72 communicating therewith in order to balance the material flow, since additional raw shale is being added through input hopper 32; alternately, some material is removed from some other point, e.g., at the separator 62 at the top of the column before the material is heated.

In an alternate embodiment of the invention, a pulse mixer, illustrated in FIG. 4*a*, can be used in place of the cascade gravity-flow mixer 36 shown in FIG. 3. Hot burned shale at about 650° C. from the cascading burner 40 or other burner configuration flows into vertical column 80, while cold raw shale at about 20° C. flows into column 82. Rotary valves 84 and 86 in columns 80 and 82, respectively, or other pulse making mechanisms such as any gate or valve that can be opened and shut periodically in a controlled manner, are 90° out of phase, so that amounts of hot recirculated shale and cold raw shale are alternately passed through connecting passages 88 and 90, respectively, which join and communicate with vertical column 92 which is mounted and communicates with the pyrolyzer 44. Thus, alternate layers of hot burned shale and cold raw shale are flowed into the top of the pyrolyzer so that effective heat transfer occurs to raise the cold raw shale to a temperature of about 500° C. for the pyrolysis reaction to occur. An alternate embodiment to provide the impeded cascaded flow in the mixer, illustrated in FIG. 4*b*, comprises alternate layers 94 of spaced parallel channels 96 impeding and splitting the flow with each horizontal layer 94 oriented perpendicular to the layer above.

Figure 5A:
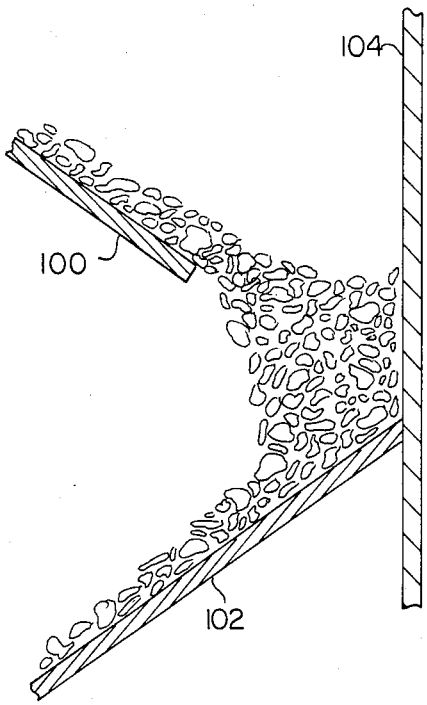
FIGS. 5*a* and 5*b* illustrate the material flow and velocity vectors showing the inversion of a flowing layer occurring in a cascade bed retort.
Figure 5B:
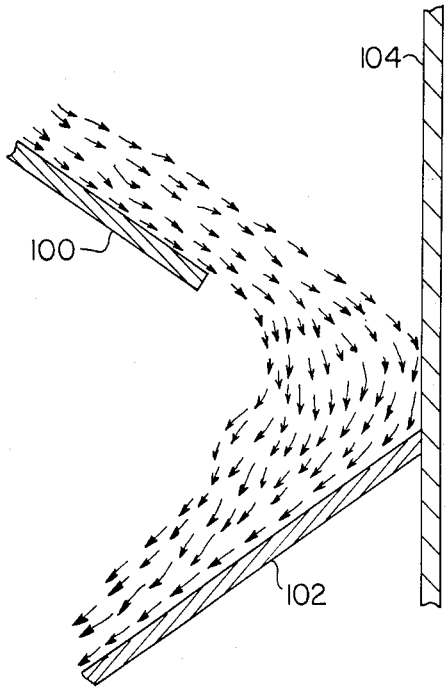

The cascading bed retort concept utilizes the properties of material flow down an inclined plane. In both the mixer and burner, the material flows down a plurality of overlapping inclined baffles or shutes alternately mounted on opposing sides of a vertical column. In the burner, segregation and mixing are not design goals but instead provide many opportunities for contact of the cascading shale with the oxidizing gas as described in the accompanying patent application on the device. In the mixer, a layer of flowing cold raw shale is added to a layer of flowing hot burned shale. Size segregation of particles occurs on an inclined plane flow, with large particles rising and small particles going to the bottom. When the flow is reversed in passing from one inclined plane to a successive inclined plane, an inversion of the top and bottom layers occurs. The invention repeats this process several times, and utilizes the subsequent resegregation of the particles as an effective mixing technique. In a continued flow down successive inclined baffles, successive inversion of the entire flowing stream with large and small particles passing through one another occur until sufficient mixing is achieved. A computer simulation of the mixing of layers by flowing down successive inclined planes is illustrated in FIGS. 5*a* and 5*b*, which illustrate the material flow and velocity vectors, respectively. FIG. 5*a* and 5*b* illustrate the inversion of the flowing layer that occurs as the material goes around a corner, i.e., flows from inclined plane 100 to inclined plane 102 which is mounted to wall 104. When the material flowing from inclined plane 100 hits the wall 104, the flow onto inclined plane 102 is reversed. As illustrated in FIG. 3, the baffles 42 in the mixer 36 and the baffles 70 in the cascading burner 40 are each made up to two segments of different angles. The steeper part of the baffle is provided so that material does not hang up and interfere with continuous flow. The angle of the lower segment of the baffle is chosen to provide the proper residence time in the system while providing continuous flow. The slope of the lower segment of the baffle measured from the horizontal is preferably in the range about 30°–50°. It can be a maximum of about 50°–60° and a minimum of about 24°–30°. The lower tip of one baffle extends laterally to about the junction between the two segments of the next baffle. The bottom baffle is generally shorter to stop the process and allow the material to fall into the next stage.

Changes and modifications in the specifically described embodiments can be carried out without departing from the scope of the invention which is intended to be limited only by the scope of the appended claims.

We claim:

1. Apparatus for retorting oil shale particles of variable size, including fines, comprising:

a substantially vertical cascading burner having a pair of opposing walls;

a plurality of vertically spaced baffles extending from the opposing walls of the burner inwardly and downwardly into the burner in an overlapping relationship, successive baffles extending alternately from opposing walls of the burner said baffles, comprise a first segment and a second segment connected to and above the first segment and having a slope greater than the first segment, wherein the first segment has a slope, measured from the horizontal, in the range of about 24°–60°;

a substantially vertical cascading mixer below the burner, the burner being mounted to the mixer and communicating therewith through an opening therebetween, the mixer having a pair of opposing walls;

a plurality of vertically spaced baffles extending from the opposing walls of the mixer inwardly and downwardly into the mixer in an overlapping relationship, successive baffles extending alternately from opposing walls of the mixer;

raw shale input means mounted to the top of the mixer adjacent to the burner and communicating with the mixer through an opening therebetween;

a substantially vertical moving packed bed pyrolyzer below the mixer, the mixer being mounted to and opening into the pyrolyzer;

spent shale removal means connected at the bottom of the pyrolyzer and communicating with the pyrolyzer through an opening therebetween; and product removal means operatively connected to the pyrolyzer.

2. The apparatus of claim 1 wherein the first segment has a slope in the range 30°–50°.

3. The apparatus of claim 1 wherein the lower tip of one baffle extends laterally to about the junction between the two segments of the next baffle.

4. The apparatus of claim 1 wherein the second segment is curved.

5. The apparatus of claim 1 wherein the raw shale input means is a funnel shaped hopper.

6. The apparatus of claim 1 wherein the spent shale removal means further includes flow control means.

7. The apparatus of claim 1 further including spent shale input means mounted on top of the burner and communicating therewith through an opening therebetween.

8. The apparatus of claim 7 wherein the spent shale input means is a funnel shaped hopper.

9. The apparatus of claim 7 further including recirculation means connected between the spent shale removal means and the spent shale input means.

10. The apparatus of claim 9 further including a solid-gas separator between the recirculation means and the spent shale input means.

11. The apparatus of claim 7 wherein the opening between the spent shale input means and burner is an adjustable size opening to provide flow control and a partial gas block.

12. The apparatus of claim 1 further including removal means operatively connected to the burner for removing a portion of the hot spent shale.

13. The apparatus of claim 12 wherein the removal means comprises an exit pipe extending from the burner adjacent the opening between the burner and mixer.

14. The apparatus of claim 1 wherein the openings between the burner and mixer, raw shale input means and mixer, and pyrolyzer and spent shale removal means are adjustable size openings to provide flow control and a partial gas block.

15. The apparatus of claim 1 wherein the product removal means comprises a plurality of spaced parallel gas collection channels extending across the top portion of the pyrolyzer.

16. The apparatus of claim 15 further including a manifold mounted on the outside of the pyrolyzer and communicating with the gas collection channels through product gas vents in the pyrolyzer.

* * * * *